US006508190B1

(12) United States Patent
Norton

(10) Patent No.: US 6,508,190 B1
(45) Date of Patent: Jan. 21, 2003

(54) SAFE REMOTELY OPERATED SINGLE OPERATOR PERSONAL BOAT MOORING SYSTEM

(76) Inventor: Daniel Norton, 318 Bonniewood Dr., Cary, NC (US) 27511

( * ) Notice: Subject to any disclaimer, the term of this patent is extended or adjusted under 35 U.S.C. 154(b) by 15 days.

(21) Appl. No.: 09/670,948

(22) Filed: Sep. 27, 2000

(51) Int. Cl.[7] ..... B63B 21/00
(52) U.S. Cl. ..... 114/230.2
(58) Field of Search ..... 114/221 R, 230.2, 114/230.1, 230.26

(56) References Cited

U.S. PATENT DOCUMENTS 2,347,718 A * 5/1944 Terry ..... 114/230.26
2,983,243 A * 5/1961 Bowers et al. ..... 114/230.26
4,932,700 A * 6/1990 Hart ..... 114/221 R
6,085,681 A * 6/2000 Morton ..... 114/221 R

* cited by examiner

*Primary Examiner*—Stephen Avila
(74) *Attorney, Agent, or Firm*—Robert Nathans

(57) ABSTRACT

A remotely operable device that enables one person to quickly attach and release a boat to and from a mooring. The device is retractable to allow for a safe and non-obstructive state while the boat is under way. A mooring buoy with a tall vertical rigid rod is targeted by a catcher at the end of a telescopic arm that is aimed by remote control at the rod on the buoy, and automatically locks with the rod upon contact with a bi-directional latch in the catcher. Guide rails extend from either side of the catcher to form a "V" to quickly enable the catcher to lock on to the rod. A mooring line can then be extended. To get the boat under way, the mooring line is reeled in, pulling the boat close. Then the remote controlled latch releases the rod. These operations can be performed by cables controllable from the cockpit of a boat or by radio or infra-red control links for controlling electronically actuated motors, latches or springs.

20 Claims, 8 Drawing Sheets

SAFE REMOTELY OPERATED SINGLE OPERATOR PERSONAL BOAT MOORING SYSTEM

BACKGROUND OF THE INVENTION

The inventor has determined through personal experiences that there exists a need for a practical method for enabling a single personal, or leisure boat operator, including a handicapped person, to hitch a boat such as a personal sailboat, yacht or motorboat to a mooring. Due to the expenses and limited space involved in maintaining and building marine docks, it is common that most harbors use moorings as well. Yet for years mooring technology for such personal boats has been limited.

A standard mooring is a buoy that is anchored to the ocean floor. Attached to the buoy is a rope or set of ropes, also called pendants, that a boat would normally be tied to when not under way. When moored properly, the mooring line is usually fed through a deck fixture on the boat and is cleated off on the boat's deck. Moorings are usually spaced apart according to boat size, in order to maximize usable storage space on the water.

The standard method for using a mooring is as follows. When a boat is under way and approaching a mooring, the boat's captain must take into consideration wind speed and direction, water currents, and other surface obstacles to align the ship's trajectory accordingly, and reduce velocity. During this time, a second person is often needed to stand ready at the ship's bow. The ship's captain must fulfill his responsibility by maneuvering the ship close enough to the mooring line or pendent to allow the second person to reach down and grab the mooring line, usually with a hook-pole. These boat hook poles having hooks or loops at the ends thereof, and are manually manipulated at the bow of the small boat by the second person, are disclosed in quite a few patents. See U.S. Pat. No. 4,932,700 to Hart; U.S. Pat. No. 4,595,223 to Hawie; U.S. Pat. No. 5,704,668 to Ferrato; U.S. Pat. No. 5,699,748 to Linskey, Jr. et al.; U.S. Pat. No. 5,799,602 to Trillo; U.S. Pat. No. 4,276,850 to Valencia. Once the second person has the mooring s/he must keep a secure foothold so as not to lose balance, and take into consideration the ship's momentum while holding the mooring line in order to secure it to the ship's deck. The boat is then moored, and the engine can be turned off or sails dropped. The reverse procedure can be performed to detach a boat from its mooring.

There are several dangers and inconveniences to using the standard method of mooring a boat. During the time the second person is in the process of grabbing the pendant and attaching it to the deck, s/he is the only link between the boat and the mooring. The person can lose balance and fall overboard. The person can lose grip of the mooring line and the boat could drift off course. The person is also in danger of being pinched by the mooring line during this time. Often the captain must rely on the second person to act as a guide as the ship approaches the mooring. Also, it is very difficult for one person to successfully and safely moor a boat alone.

It is thus an important object of the invention to eliminate this undesirable standard procedure with its often nerve-wracking dangers and inconveniences.

A second important object of the invention is to enable a single operator, who could even be physically handicapped, to aim a mooring pole in the general vicinity of a mooring device such as a buoy, and have the device quickly and readily attach itself to the buoy even if the boat is severely gyrating in rough water. This is in contrast with the disclosure in U.S. Pat. No. 4,276,850 to Valencia, which has a small target latching device on a dock so that an elongated mooring pole has to be carefully aimed at the small target latching device. Also, it would appear that this elongated pole can injure a person standing on a dock more readily than the terminal portion of the catcher device of the present invention. The present invention is directed to the aforesaid problems and desired benefits involving personal or leisure watercrafts including luxury yachts, and is not directed at, or is intended to cover, the mooring of large transport ships as disclosed for example in U.S. Pat. No. 4,114,556 to Orndorffet al.

SUMMARY OF A PREFERRED EMBODIMENT OF THE INVENTION

Mooring of a small boat can be safely, remotely controlled by a single boat operator from the cockpit by providing a mooring buoy having a rigid upwardly extending vertical rod which is targeted by a catcher unit arm member mounted upon the deck of the boat, having a bidirectional latch at its end for coupling and decoupling the arm to and from the vertical rod on the buoy by remote control. As the boat approaches the mooring area, the arm is aimed at the vertical rod on the buoy until the arm mounted catching device engages the rod on the buoy and thus couples the boat to the buoy. A mooring line is then deployed between the catching device and the boat to permit the boat to back away a substantial distance from the mooring buoy and yet be coupled to it. Upon departing from the mooring area, the mooring line is reeled in to move the boat toward the buoy and the catching device latch is remotely operated from the cockpit to release the catcher arm and thus the boat from the vertical rod on the buoy.

A pair of elongated guide rails extend from the catcher by several feet, forming a "V" pointing toward the boat, for guiding the vertical rod on the mooring buoy into a central latching portion of the catching device as the boat approaches the buoy, thereby readily initiating quick and easy mooring of the boat, even in rough water where the boat may be gyrating about. The arm member is telescopic to stow it safely when the boat is under way. The arm member is hollow, and thus contains and guides the mooring line attached at one end to the catcher and at the other end to the boat.

BRIEF DESCRIPTION OF THE DRAWINGS

The various features of the invention will become more apparent upon further study of the detailed description taken in conjunction with the drawings in which.

DETAILED DESCRIPTION OF PREFERRED EMBODIMENTS OF THE INVENTION

Figure 1:
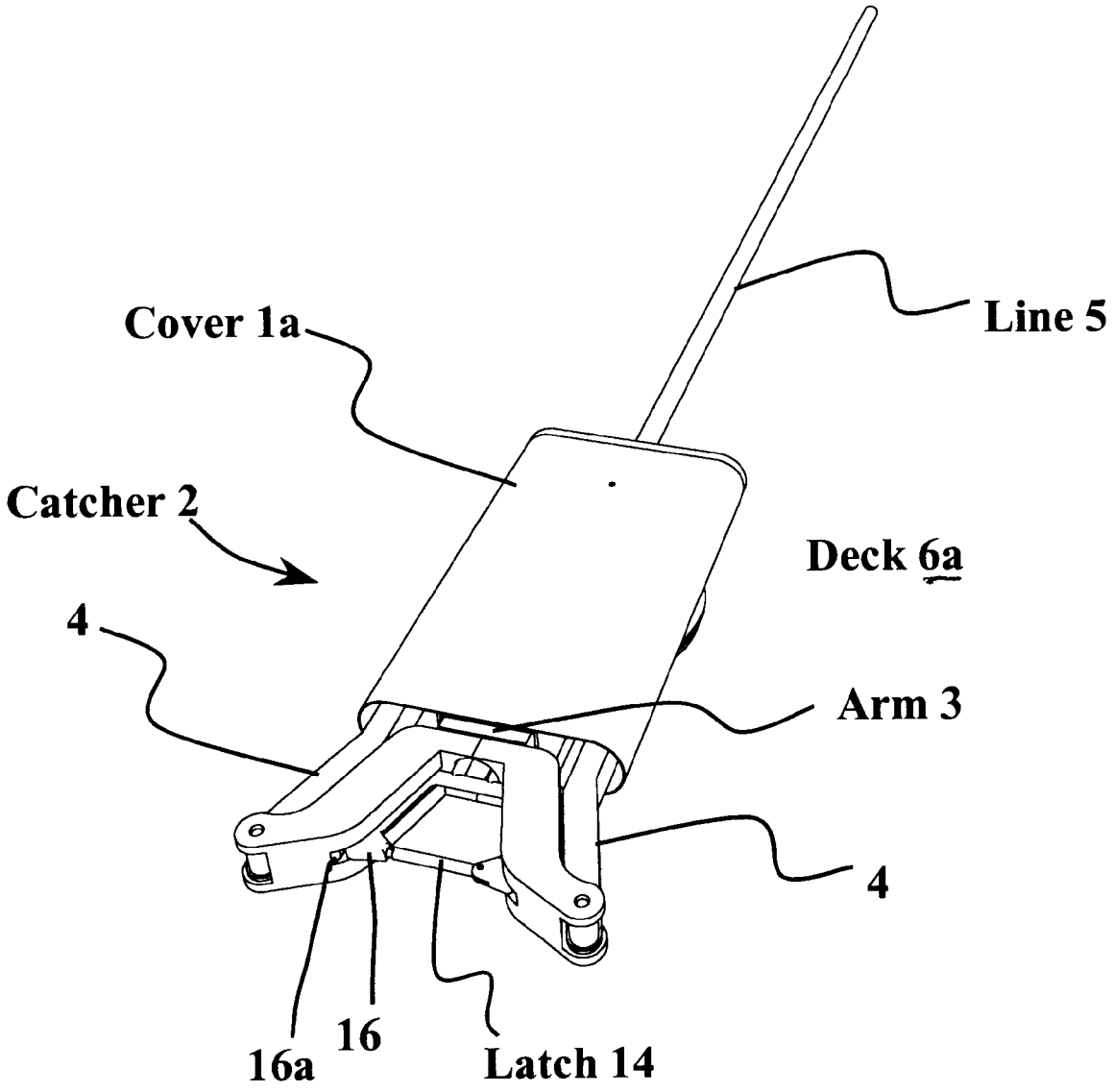
FIG. 1 shows the 3 Degree of Freedom (DOF) catcher assembly in its retracted, or collapsed state that it should be in when the boat is under sail.
Figure 2:
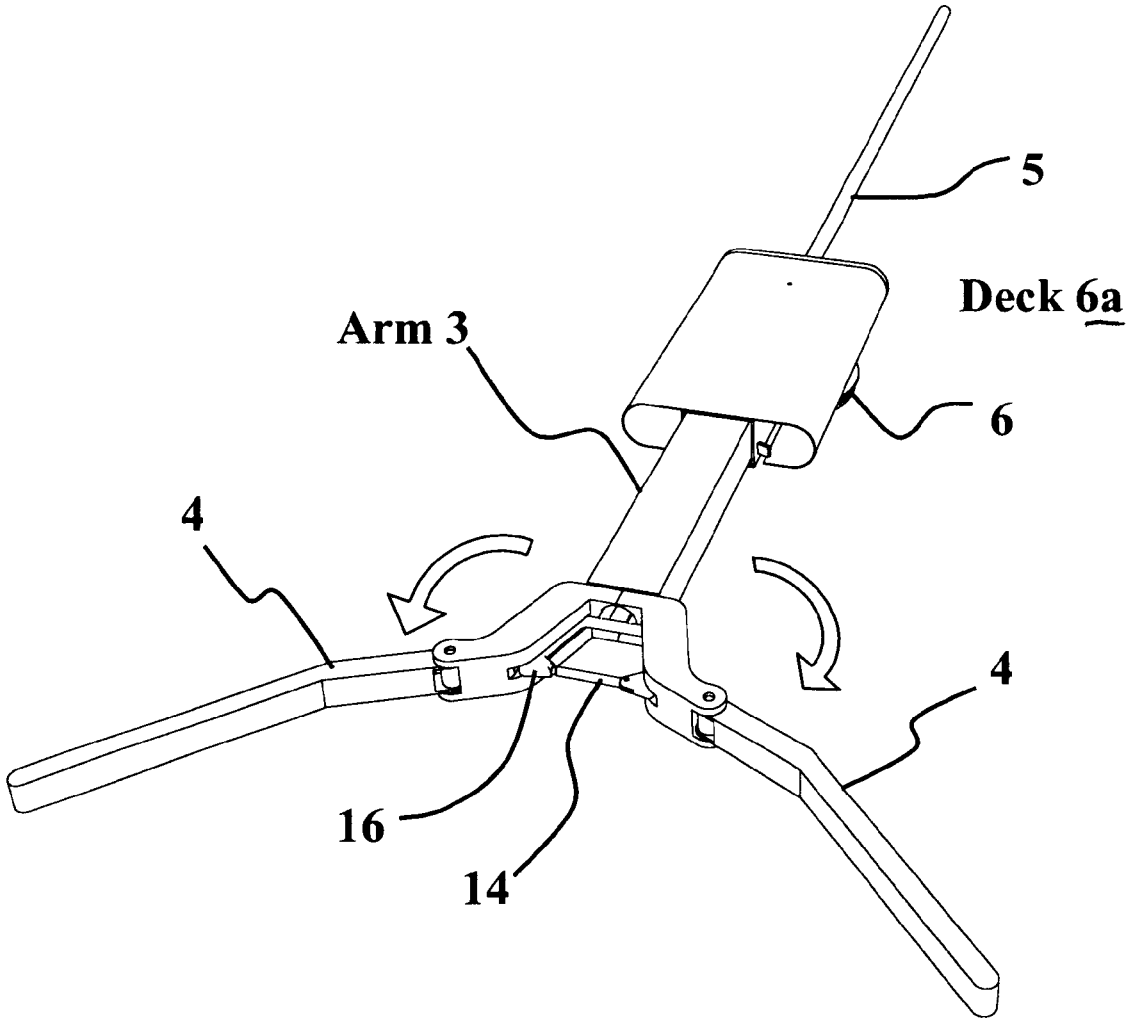
FIG. 2 shows the 3 DOF arm as it is deployed and shows how the inner arm 3 moves outward from the rest of the assembly, and how the two guide rails 4 swing outward into position. The guide rails exist to help feed in the modified mooring's "T" shaped extension, shown in FIG. 3, into the catcher latch.
Figure 3:
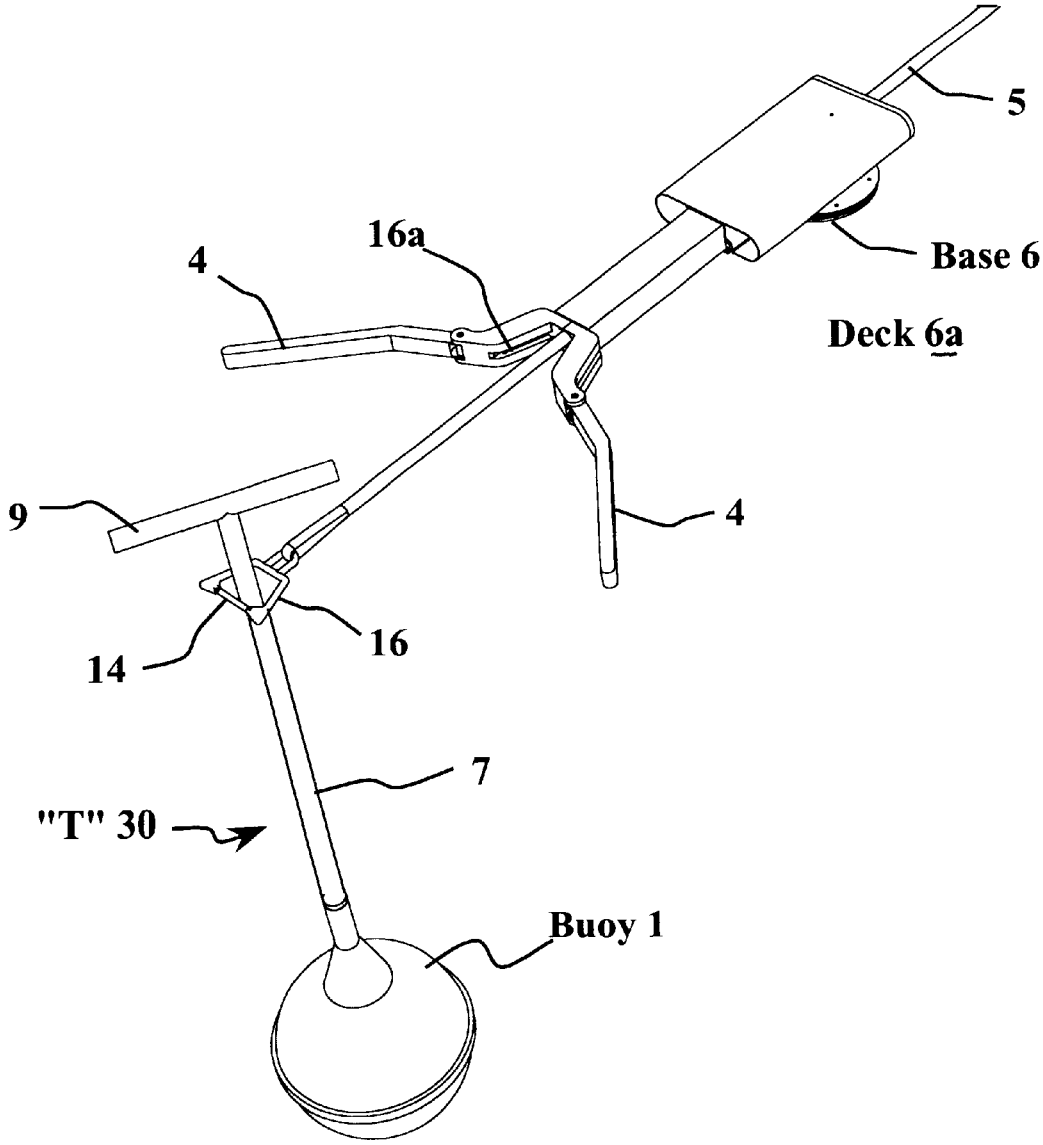
FIG. 3 illustrates the catcher assembly in its ally deployed state and coupled to the modified mooring buoy.

Referring now to FIGS. 1–3, the apparatus of the mooring system of the invention consists of four main assemblies namely: a modified mooring buoy 1 that provides a rigid member to hitch a boat to, a three degree of freedom arm 3 that functions by serving as a positional guide through which a modified mooring line 5 runs in order to lock to the rigid vertical rod 7 of the modified buoy.

More specifically, the first of the four assemblies is a modified mooring buoy 1 in FIG. 3, consisting of a standard buoy or float that is anchored to the ocean floor. Attached to this buoy is a metallic rigid rod 7, protruding out from the top of the buoy vertically into the air about four to six feet. The rigid rod is bent or welded so it forms a "T" 9 at the top. The height of this rod corresponds to the height range of the bows of common personal watercrafts. Attached to the bottom of the buoy is a submerged mass, not shown in the figures, which is used to counterbalance the rigid rod on top.

The second assembly is a three degree of freedom remotely controllable catcher device 2 that is permanently attached to the boat's deck, centered near the ship's bow. It is shown in a collapsed compact state in FIG. 1. The first degree of freedom of this device consists of a rotatable base 6 in FIG. 3, that pivots about 180 degrees in a horizontal plane. Attached to the base is a spring-actuated telescoping arm 3, comprising the second degree of freedom. A set of spring actuated guide rails 4 are attached to the end of the arm 3, and are actuated simultaneously, thus making up the third and final degree of freedom. Importantly, all three degrees of freedom can be remotely controlled by a series of cables that feed back to the cockpit, or otherwise via radio or infra-red controlled motors and latch or spring releasing relays.

The third assembly is a modified mooring line that consists of a standard mooring rope or line 5 that on one end is permanently attached to the ship via cleat or other means of securing. The length of the line is fed through the hollow telescoping arm 3 of the three-degree of freedom assembly. The opposing end of the line is attached to a catching eyelet or catch-eye 16; see FIG. 3. The catcher eye consists of a bi-directional clip latch 14 that can be set or un-set from the remote control unit at the cockpit. When not deployed, clip 16 rests in a groove at the tip 8 of the telescoping arm.

The fourth assembly is the control unit mounted in the cockpit that can consist of a series of small wenches and levers all attached to cables that feed up to the telescoping device in order to actuate the three degrees of freedom and the bi-directional clip latch.

When in operation, as the ship approaches the modified mooring, the 3 DOF mooring control catcher unit 2 is aimed at the vertical rod 7 and "T" top member, extending from the modified buoy. These components should have a bright color and a brightly colored flag for easy visibility. The retracted telescoping arm 3 shown in FIG. 1, is extended as shown in FIG. 2, and the guide rails 4 which were "tucked in" per FIG. 1 for compactness, are deployed by the release of torsion springs, so they are at 90 degrees with each other but 45 degrees to the arm so as to form a "V" shape which points toward the boat's stern, all as indicated in FIG. 2. By remote control, the captain actuates the rotatable base 5 to rotate and aim the arm 3 in the direction of the mooring. Also, the telescoping arm 3 is extended by unlocking a compressed spring adjacent the arm 3, also by remote control. The captain now only has to steer the boat so that the guide rails can guide the catcher toward the vertical rod on the mooring buoy.

The forward motion of the ship now causes the modified mooring's rigid vertical rod 7 to be fed into the modified mooring line's bi-directional catch-eye or clip 16 with its latch 14, by the guiding action of the extended guide rails that press against the vertical rod upon closure. This is a very important aspect of the invention. The "V" guide rail configuration acts as a very efficient guide to lead the catcher to the vertical buoy rod, even if the boat is gyrating due to rough waters. Thus the single person operator need not have substantial skill in aiming the catcher at the buoy due to the widely extending guide rails which generally will be positioned substantially in a horizontal plane. They would each have a typical length of about one to two feet. A section of the rigid rod of the modified buoy then becomes locked inside the catch eye clip to secure the mooring of the boat. As the rod 7 on the buoy enters the catcher eye, the bi-directional latch 14 yields to allow the rod to enter the eye. The latch then springs back by means of a latch torsional spring, locking the "T" buoy extension into place, and the boat is now secured to the mooring.

Once the mooring line is secured, the modified mooring line can be deployed, or reeled out like a fishing reel, from the arm 3 by a desired distance away from the buoy, to properly position the moored boat, and the mooring line 5 is secured to the boat via a cleat or other means. The slacking of the mooring line can be done either manually or by an automatic crank device or winch, to reel back in safely, and the catcher arm 3 is retracted. In other words the modified mooring line is allowed to feed out of the arm to a predetermined, proper mooring distance, as the boat backs away from the buoy as indicated by arrow 5*a* in FIG. 3.

When the boat is at rest at the mooring, the catcher device is completely retracted, and serves as a feed through which the mooring line is fed. The hollow telescopic arm 3 also serves as a stress reliever for the mooring line when at this state of operation. The arm is thus not intended to bear the force of the mooring line. Instead, the mooring line is secured to the deck via a cleat or similar means.

To free the boat from the mooring, the 3 DOF catcher unit must first be deployed. Next, the mooring line must be reeled in via the remote control unit or existing deck winch until the mooring clip 16 latches into the grooved pocket 16*a*. Next, the bi-directional clip latch 14 is opened by remote control and the modified mooring's rigid rod is released as the boat is backed away from the buoy. The 3 DOF arm is then retracted, see FIG. 1.

Figure 4:
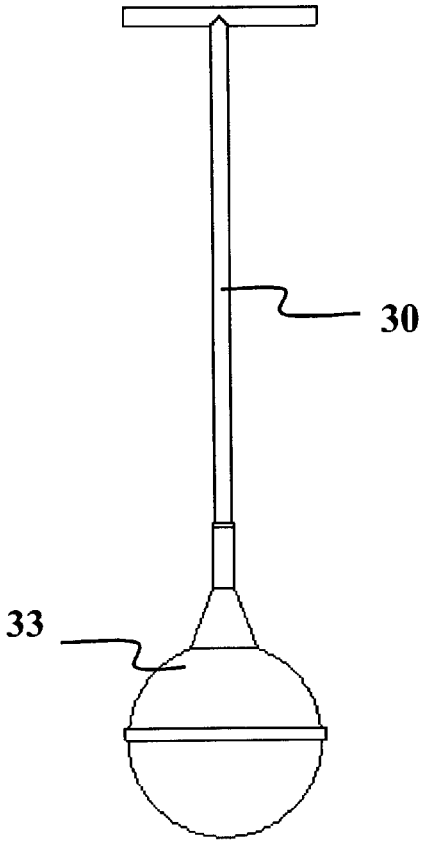
FIGS. 4 and 5 illustrate a preferred construction of the modified mooring buoy.
Figure 5:
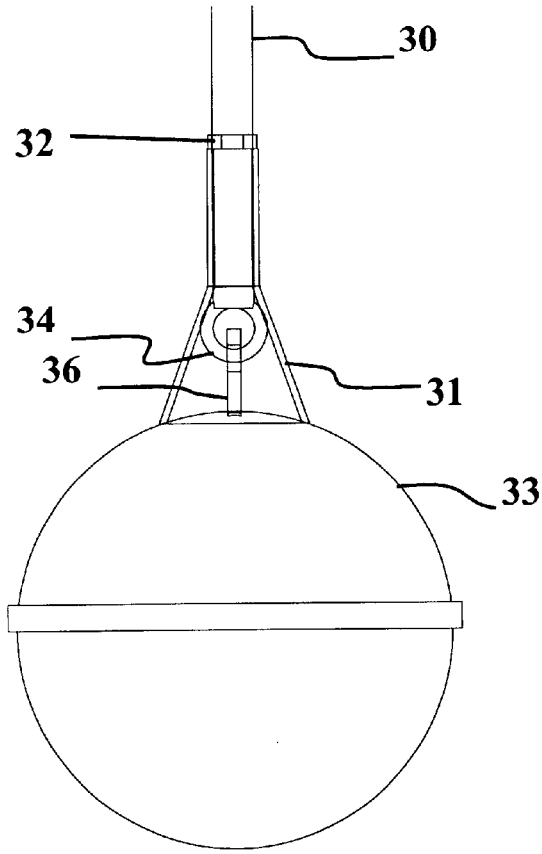

FIGS. 4 and 5 show a preferred design for the mooring extension. The extension is designed to attach directly to an existing mooring buoy 33. The "T" shaped extension 30 has a loop 34 on its end that connects to the loop 36 on the standard mooring buoy. A threaded nut 32 coacts with a threaded portion of rod 30 and is tightened to clamp a funnel shaped clamp 31 down onto the surface of the buoy, thus holding the "T" Extension upright and vertical.

Figure 6:
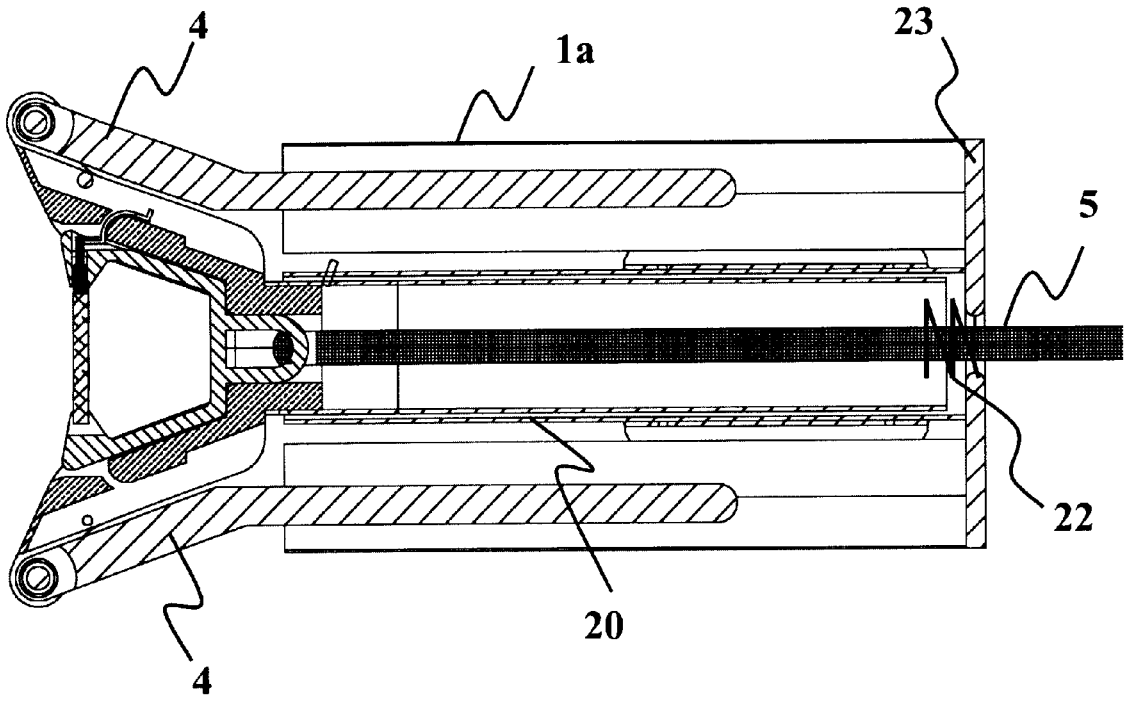
FIG. 6 is a cross section of the catcher device in FIG. 1, illustrating a compressed spring for telescoping arm actuation, and a protective spring sleeve.

FIG. 6 is a cross section of the same device in FIG. 1. Labeled in this figure are the following: the back plate 23 serves as a connecting plate for the cover 1*a* and outer fixed tube 21, and has a hole in its center through which the mooring line 5 exits. A spring 22 is shown in its compressed state that is used to provide linear thrust for the inner telescoping tube 20 to move. The guide rails 4 are shown also cross sectioned. In his retracted state FIG. 6 also shows that the cover 1*a* is designed so that it forms a pocket for each guide rail to remain in until the device is released.

Figure 7:
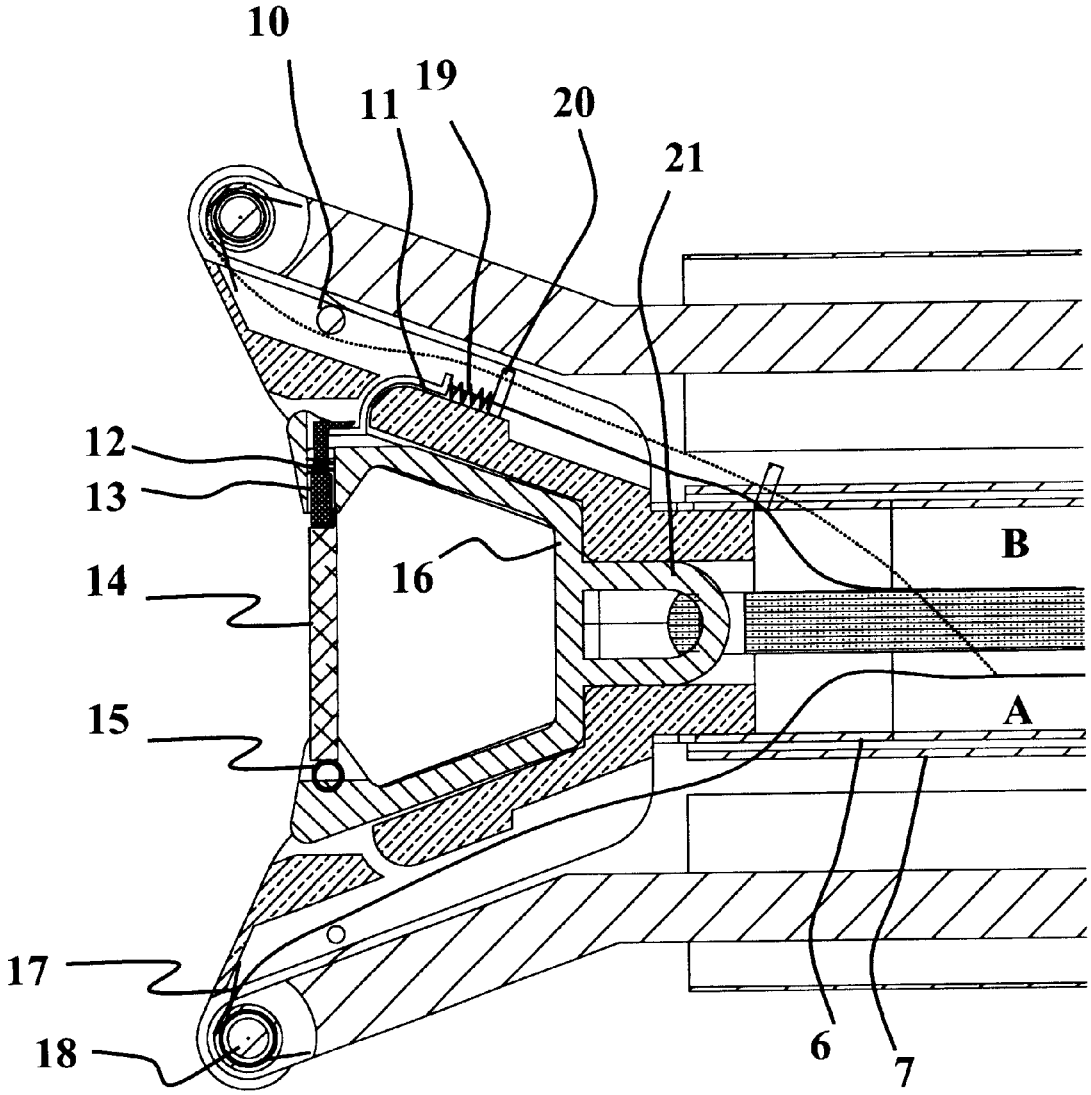
FIG. 7 shows a close up of FIG. 6, and shows some of the smaller items that make up the 3 DOF arm.

FIG. 7 shows a close up of FIG. 6, and shows some of the smaller items that make up the 3 DOF arm. For example, the catch eye 16 is attached to the mooring line 5 and both comprise the majority of the modified mooring line assembly. Attatched to the catch eye 16 is the latch 14 that serves to lock the mooring's "T" extension inside the eye 16. The latch 14 is actuated by the force of the "T" extension, and then is locked back into place by the means of the latch torsion spring 25. The latch 14 is bi-directional. That is, when the latch lock 13 is released, the latch can pivot in the opposing direction to allow the "T" extension to exit the catch eye 16. The latch lock is actuated by cable line B, and the latch lock spring 12. The guide rail torsion springs 17 provide the forces needed to swing the guide rails 4 into to deployed position. The guide rails 4 pivot on the guide rail hinges 18. These hinges are also hollow so as to house the guide Rail torsion springs 17. The guide rails and the telescoping arm 3 are pulled back into the retracted positon through the actuation of line A, which is shown to fork off and terminate around the surfaces of both guide rail hinges 18; see FIG. 9*a*. There exists a guide pulley 10 inside each side of the catch eye housing 4*a* to aid in the necessary change in direction that line A must take.

Figure 8:
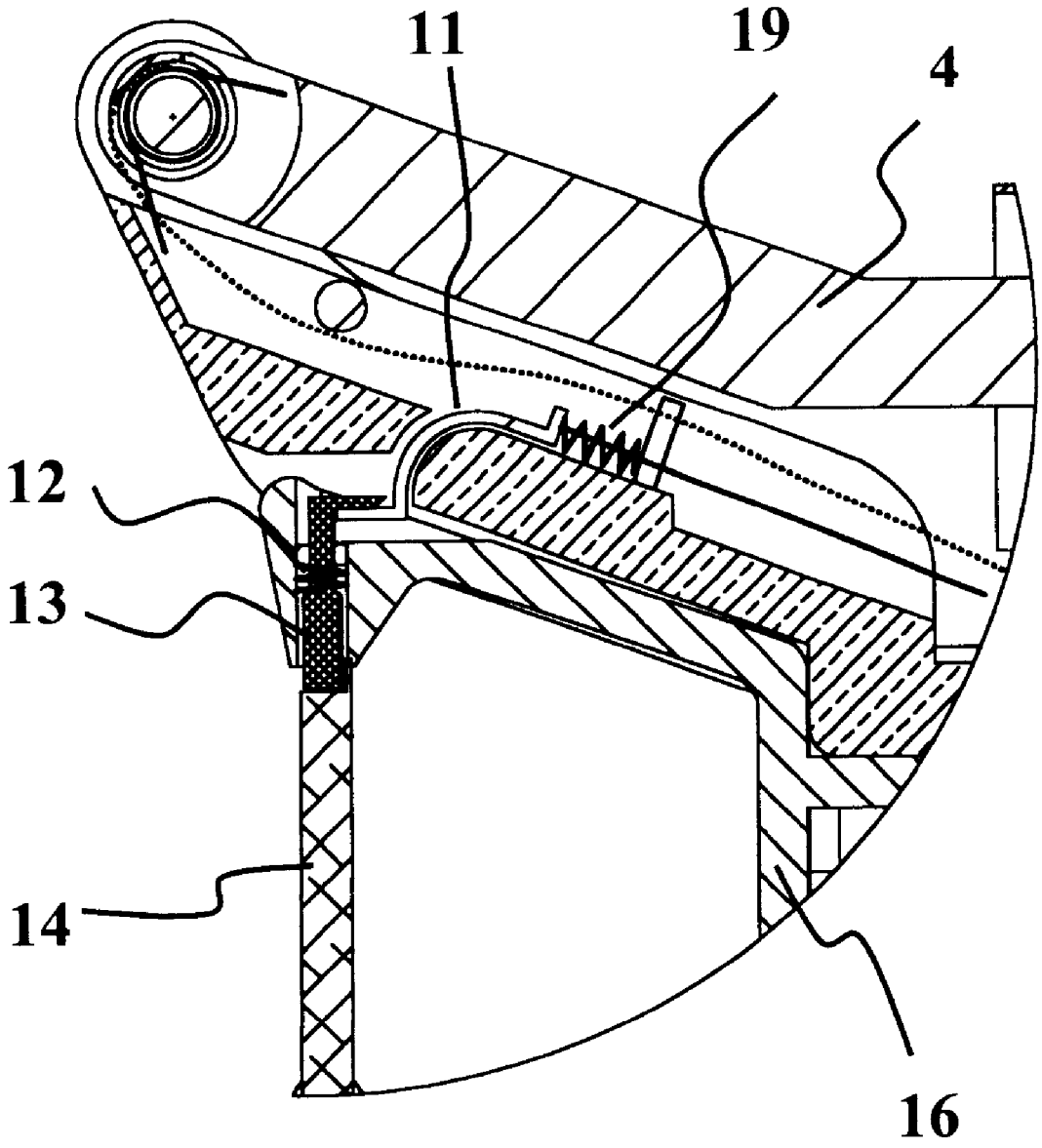
FIG. 8 shows a close up cross section of an interface that exists in between the catch eye, which pulls away from the 3 DOF arm during operation, and the catch eye housing 4, which is fixed to the arm.

FIG. 8 shows a close up cross section of an interface that exists in between the catch eye, which pulls away from the three DOF arm during operation, and the catch eye housing 4*a*, which is fixed to the arm. The interface is the connection of the flex lever or metal band 11, and the latch lock 13. To describe further, the flex lever 13 is housed inside the catch eye housing 4*a*, and serves as the connection to the latch lock 13 when the modified mooring line is pulled completely in. Actuation of this flex lever causes the latch lock to release or engage, depending on which stage of operation the device is in. A spring release mechanism is also provided comprising a leaf spring-actuated lock that holds the inner telescoping tube 6 in place during the retracted mode of operation. Upon pulling Line C, FIG. 9*a*, the operator bends the leaf spring to disengage the release mechanism from the inner tube 6, thus actuating the compressed telescoping spring 22, and deploying the arm.

Figure 9A:
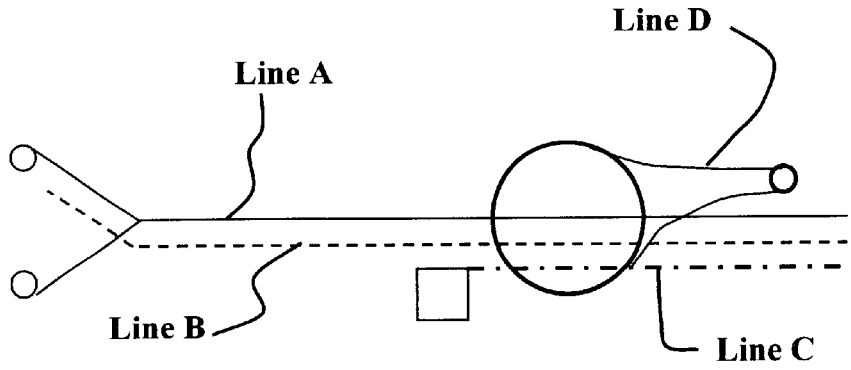
FIGS. 9*a* and 9*b* show respectively, one arrangement of the actuating cables and the catcher in its extended position with the extended telescope spring.
Figure 9B:
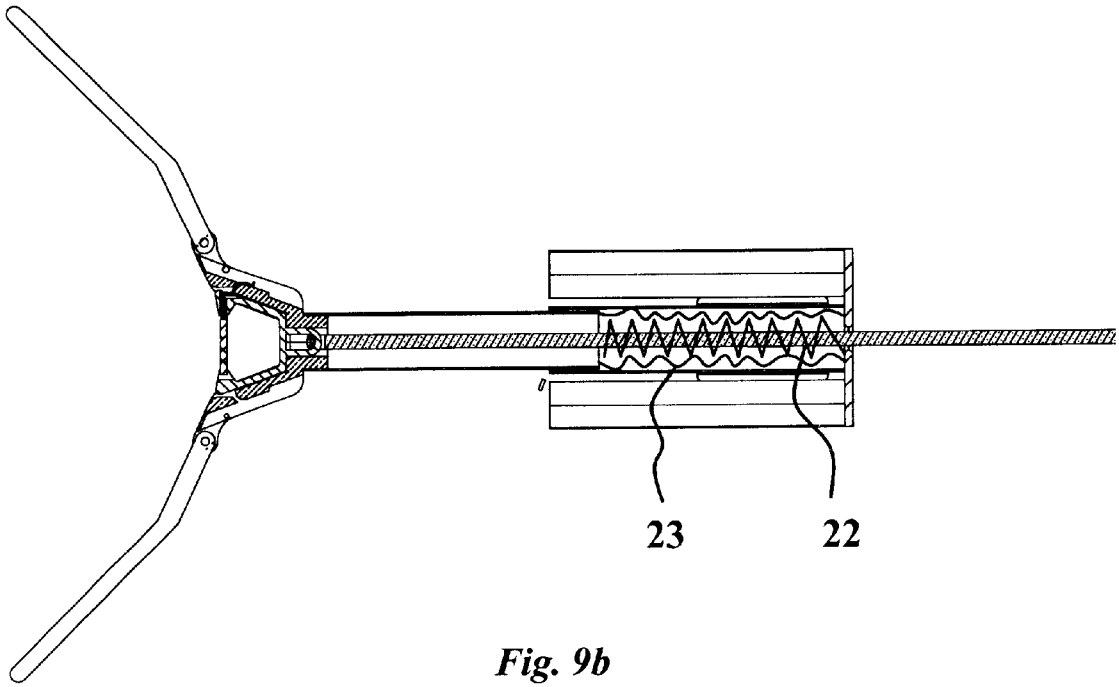

FIG. 9 is a cross section of the device in FIG. 3. Detailed here is the spring for telescoping actuation 22, and a protective spring sleeve 23 to act as a barrier between the actuation cables and the spring.

FIG. 9*a*, above FIG. 9, shows a simplified schematic of the actuation cables for the assembly. Line A begins at both guide rail hinges 18, and is fed through the catch eye housing 4*a* and through the center of both tubes 20 and 21. Pulling line A will pivot both guide rails to their collapsed position. Further pulling of line A will then collapse the telescoping arm until locked, recompressing the springs. Line B originates at the flex lever 11, and is fed in the same fashion as Line A. Pulling line B actuates the flex lever which in turn pulls the latch lock inward, thus allowing bi-directional clip-latch to open outward to release the mooring extension. Releasing line B allows springs to return the latch lock to the original position. Line C originates at the aforesaid leaf spring release mechanism of FIG. 8 to actuate it. Line D originates at the rotating base 6 to cause it to rotate to aim the arm as described above. As is readily apparent to those skilled in the art, all lines can be fed through a series of guiding tubes and pulleys until they terminate at a control unit at the cockpit of the vessel.

Since numerous variations of the foregoing will occur to the skilled worker in the art, the scope of the invention is to be limited by the true spirit of the invention and/or by the terms of the claims and equivalents thereof. For example, the vertical rod could be mounted upon any suitable mooring means such as a dock rather than upon a buoy. Also, the arm may be aimed at the mooring means solely by steering the boat rather than by the preferred mode of rotating the arm in the horizontal plane. While the remote control operations have emphasized cable operation, these remote control functions can be carried out by the transmission of RF, IR or ultrasonic waves by the single person in the cockpit to control positioning motors, latching relays or spring release mechanisms to perform the aforesaid functions. The details thereof are well within the skill of workers in the art as are further cable actuation details. While far less preferred, the mooring line could conceivably be eliminated, and a long elongated arm could be stored in a rack along the side of the boat and could couple the boat very close to the mooring member; likewise the arm need not be telescoped at all and could extend a few feet from the boat at all times, although this is hardly preferred.

I claim:

1. A system for enabling, if desired, a single boat operator to attach and release a personal boat from a mooring comprising in combination:

(a) a mooring means having a rigid, substantially vertical elongated member along with (b) an arm member mechanically coupled to said personal boat having a mooring member catching means at a terminal portion of said arm for coupling and decoupling said arm to and from said rigid, substantially vertical elongated member of the mooring means;

(c) aiming means mounted upon said personal boat for aiming said arm at said vertical elongated member until said catching means engages the rigid, substantially vertical elongated member of said mooring means upon said personal boat approaching said mooring member;

(d) mooring line deployment means for deploying a mooring line between said mooring member catching means and said boat to enable said boat to back away a substantial distance from said mooring means while being coupled thereto; and (e) actuation means for remotely actuating said catching means causing it to decouple from the vertical elongated member of said mooring means upon departure of the boat from said mooring means.

2. The combination as set forth in claim 1 wherein said arm member is telescopic to get it out of the way when said small boat is under way.

3. The combination as set forth in claim 2 wherein said arm member is hollow and contains a portion of said mooring line attached to said catching means.

4. The combination as set forth in claim 1 including guide means extending from said mooring member catching means for guiding said vertical elongated member of said mooring means into a central portion of said catching means, thereby readily enabling quick and easy mooring of said boat, even in rough water.

5. The combination set forth in claim 4 wherein said guide means comprises a pair of elongated guide members extending away from opposite sides of said catching means.

6. The combination set forth in claim 2 wherein said pair of elongated guide members are oriented to form a "V" pointing in the direction of the boat.

7. The combination set forth in claim 2 wherein said rigid, substantially vertical elongated member is coupled to a buoy via a funnel clamp.

8. The combination set forth in claim 1 including an upper restraining member extending across an upper portion of said substantially vertical elongated member.

9. The combination set forth in claim 1 wherein said rigid, substantially vertical elongated member is coupled to a buoy via a funnel clamp.

10. A system for enabling, if desired, a single person boat operator to attach and release a personal boat from a mooring comprising in combination:

(a) a mooring means having a rigid, substantially vertical elongated member along with (b) an arm member mechanically mounted upon a deck portion of said personal boat having a mooring member catching means at a terminal portion of said arm for coupling and decoupling said arm to and from said rigid, substantially vertical elongated member of the mooring means;

(c) guide means extending from either side of said mooring member catching means and oriented to form a "V" for guiding said vertical elongated member of said mooring means into a central portion of said catching means, thereby readily enabling quick and easy mooring of said boat, even in rough water;

(d) remote control aiming means mounted upon said personal boat for aiming said arm at said vertical elongated member until said catching means engages the rigid, substantially vertical elongated member of said mooring means upon said personal boat approaching said mooring member;

(e) mooring line deployment means for deploying a mooring line between said mooring member catching means and said boat to enable said boat to back away a substantial distance from said mooring means while being coupled thereto; and (f) actuation means for remotely actuating said catching means causing it to decouple from the vertical elongated member of said mooring means upon departure of the boat from said mooring means.

11. The combination as set forth in claim 10 wherein said arm member is telescopic and contains a portion of said mooring line attached to said catching means.

12. Method of enabling if desired a one person operation of attaching and releasing a personal boat from a mooring comprising the steps of:

(a-1) providing a mooring means having a substantially vertical elongated member along with (a-2) an arm mechanically mounted upon said personal boat having a mooring member catching mechanism upon a portion of said arm for coupling and decoupling said arm to and from said substantially vertical elongated member of the mooring means;

(b) upon said boat approaching the mooring means, aiming said arm at said vertical elongated member until said catching mechanism engages the vertical elongated member of said mooring means; and (c) upon departing from said mooring means, remotely actuating said catching mechanism causing it to decouple from the vertical elongated member of said mooring means and (d) deploying a mooring line between said mooring member catching mechanism and said boat to enable said boat to back away a substantial distance from said mooring means while being coupled thereto via said mooring line.

13. The method of claim 12 including aiming said arm at said vertical elongated member by remote control of said arm.

14. A system for enabling, if desired, a single boat operator to attach and release a personal boat from a mooring comprising in combination:

(a) a mooring means having a rigid, substantially vertical elongated member and (b) an arm member mechanically coupled to said personal boat having a mooring member catching means for coupling and decoupling said arm to and from said rigid, substantially vertical elongated member of the mooring means; and (c) actuation means for remotely actuating said catching means causing it to decouple from the vertical elongated member of said mooring means upon departure of the boat from said mooring means and (d) guide means extending from said mooring member catching means for guiding said substantially vertical elongated member of said mooring means into a central portion of said catching means, thereby readily enabling quick mooring of said boat, even in rough water.

15. The combination set forth in claim 14 wherein said guide means comprises a pair of elongated guide members extending away from opposite sides of said catching means.

16. The combination set forth in claim 15 wherein said pair of elongated guide members are oriented to form a "V" pointing in the direction of the boat.

17. The combination set forth in claim 15 including means for folding said pair of elongated guide members folded inwardly so that they do not get in the way when said boat is underway.

18. The combination set forth in claim 14 including an upper restraining member extending across an upper portion of said rigid substantially vertical elongated member.

19. A system for enabling, if desired, a single boat operator to attach and release a personal boat from a mooring comprising in combination:

(a) a mooring means having a rigid, substantially vertical elongated member and (b) an arm member mechanically coupled to said personal boat having a mooring member catching means for coupling and decoupling said arm to and from said rigid, substantially vertical elongated member of the mooring means; and (c) actuation means for remotely actuating said catching means causing it to decouple from the vertical elongated member of said mooring means upon departure of the boat from said mooring means and (d) deployment means for deploying a mooring line between said mooring member catching means and said boat to enable said boat to back away a substantial distance from said mooring means while being coupled thereto.

20. The combination as set forth in claim 14 including deployment means for deploying a mooring line between said mooring member catching means and said boat to enable said boat to back away a substantial distance from said mooring means while being coupled thereto.

* * * * *